US005819474A

United States Patent [19]

Strom

[11] Patent Number: 5,819,474

[45] Date of Patent: Oct. 13, 1998

[54] TEMPORARY SHELTER AND METHOD OF MAKING SAME

[76] Inventor: Willard H. Strom, 189 N. Fiore Pkwy., Vernon Hills, Ill. 60061

[21] Appl. No.: 832,597

[22] Filed: Mar. 31, 1997

Related U.S. Application Data

[63] Continuation of Ser. No. 309,195, Sep. 20, 1994, abandoned.

[51] Int. Cl.[6] ..... E04H 9/16; E04H 15/00

[52] U.S. Cl. ..... 52/4; 52/63; 52/DIG. 12; 52/DIG. 13; 135/87; 135/115; 135/117; 135/121; 135/908

[58] Field of Search ..... 24/381, 397, 398; 52/4, 5, 23, 63, DIG. 13, DIG. 12; 135/87, 90, 96, 115, 116, 117, 121, 908

[56] References Cited

U.S. PATENT DOCUMENTS

| | | | |
|---|---|---|---|
| 1,726,887 | 9/1929 | Clamp . | |
| 2,122,532 | 7/1938 | Mims et al. . | |
| 2,153,081 | 4/1939 | Goodale | 135/96 |
| 2,193,469 | 3/1940 | Ashton . | |
| 2,843,201 | 7/1958 | Laubenthal . | |
| 2,854,070 | 9/1958 | Flanigan . | |
| 3,136,356 | 6/1964 | Mears . | |
| 3,251,399 | 5/1966 | Grossman | 52/DIG. 13 X |
| 3,561,518 | 2/1971 | Johnson | 52/63 X |
| 3,601,825 | 8/1971 | Moorhead et al. | 135/96 X |
| 3,685,103 | 8/1972 | Severino | 24/381 |
| 3,755,993 | 9/1973 | Cote | 24/398 X |
| 3,785,014 | 1/1974 | Canepa | 24/381 |
| 3,849,841 | 11/1974 | Borzner, Jr. . | |
| 3,925,858 | 12/1975 | Thaeler | 24/381 |
| 3,929,145 | 12/1975 | Schroeder . | |
| 4,074,682 | 2/1978 | Yoon | 52/63 X |
| 4,081,882 | 4/1978 | Toepelt et al. . | |
| 4,081,883 | 4/1978 | Ishii et al. . | |
| 4,083,582 | 4/1978 | Villafana | 24/381 X |
| 4,084,358 | 4/1978 | Winters | 52/4 |
| 4,091,584 | 5/1978 | Brown | 52/63 X |
| 4,144,899 | 3/1979 | Kays . | |
| 4,162,892 | 7/1979 | Wright et al. . | |
| 4,197,681 | 4/1980 | Holcombe | 52/DIG. 13 X |
| 4,220,298 | 9/1980 | Willis . | |
| 4,308,644 | 1/1982 | Brown . | |
| 4,373,570 | 2/1983 | Nussdorff . | |
| 4,438,614 | 3/1984 | Raith et al. . | |
| 4,766,918 | 8/1988 | Odekirk | 135/90 X |
| 4,819,308 | 4/1989 | Baroky . | |
| 4,884,589 | 12/1989 | Simpson | 52/63 X |
| 4,909,004 | 3/1990 | Panttila . | |
| 4,928,581 | 5/1990 | Jacobson . | |
| 4,977,662 | 12/1990 | Moreland . | |
| 5,007,145 | 4/1991 | Kim . | |
| 5,008,985 | 4/1991 | Thompson . | |
| 5,031,516 | 7/1991 | Jacobson . | |
| 5,067,207 | 11/1991 | Semons | 135/115 X |
| 5,078,096 | 1/1992 | Bishop et al. | 135/116 X |
| 5,189,764 | 3/1993 | Herrington et al. . | |
| 5,222,513 | 6/1993 | Hilliard . | |
| 5,255,418 | 10/1993 | Chen . | |
| 5,259,656 | 11/1993 | Carroll . | |
| 5,271,655 | 12/1993 | Ball et al. . | |
| 5,311,648 | 5/1994 | Semons | 24/381 |

*Primary Examiner*—Carl D. Friedman
*Assistant Examiner*—Kevin D. Wilkens

[57] ABSTRACT

A temporary shelter for use with an existing frame structure is provided. The temporary shelter has a flexible sheet having a pair of parallel slits. The flexible sheet encloses the frame structure to define an inner shelter space. A pair of zipper structures are provided. Each zipper structure has a separable zipper chain composed of two interlocking halves having fastening elements attached to flexible tapes. The fastening elements are interlocked and separated by a slider. The slider is operatively connected to the interlocking halves. Each flexible tape has an adhesive strip located on a back portion of the flexible tape and extends along side and parallel to the fastening elements. The adhesive strips of the zipper structures are attached to an outside surface of the flexible sheet so that the zipper structures are in a parallel spaced apart upright relationship from one another with each zipper chain being adjacent and parallel to one of the slits to provide a closeable opening in the flexible sheet for allowing access into the inner shelter space.

13 Claims, 5 Drawing Sheets

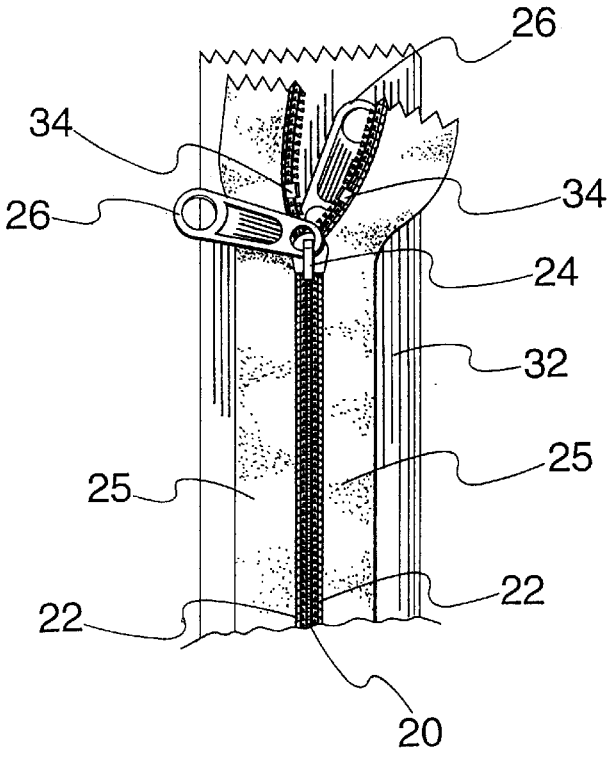
*Fig. 3.*
*Fig. 4.*
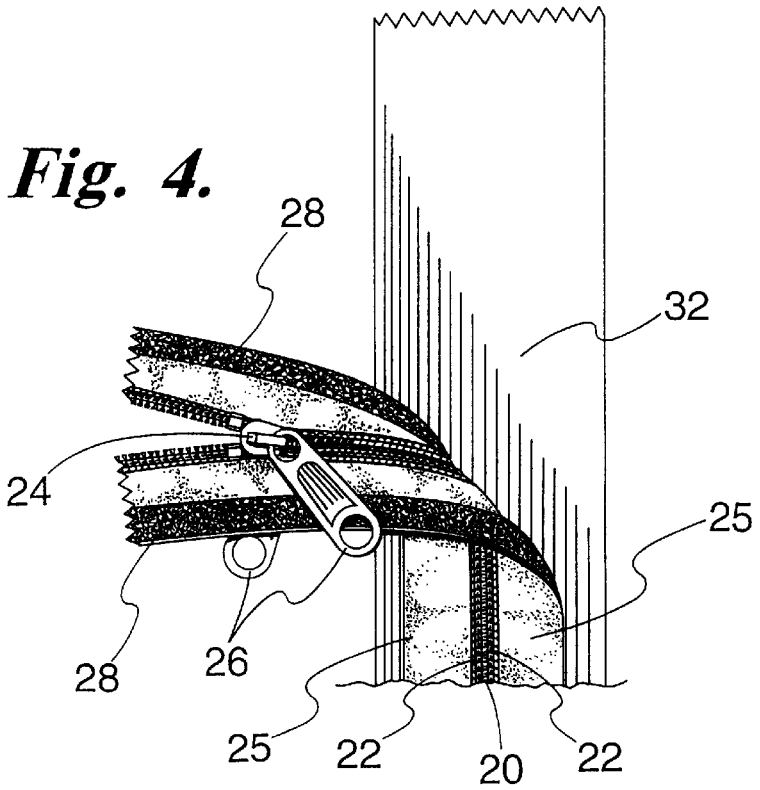

TEMPORARY SHELTER AND METHOD OF MAKING SAME

This application is a continuation of application Ser. No. 08,309,195 filed on Sep. 20, 1994, now abandoned.

BACKGROUND OF THE INVENTION

1. Field of the Invention

The present invention relates generally to temporary shelters. More particularly, the invention pertains to an improved temporary shelter entry and exit system and method of making same.

2. Description of the Prior Art

Various types of temporary shelters, such as construction shelters, are known in the art. The basic design of temporary shelters includes a frame structure with a tarp or flexible sheet draped or fitted over to define an inner space.

In building construction, construction shelters are commonly built to either define a space around an existing frame structure or within an existing frame structure. Construction shelters utilizing the existing exterior frame structure of a building are often used with buildings under construction. The shelter provides an outer protective layer to enclose a roof and side walls to prevents water damage to the structure and its contents during inclement weather, as well as allowing builders to be able to continue work inside the structure.

Constructions shelters are also commonly constructed within an existing structure when it is necessary to contain or separate a particular area from the rest of a building. For example, the remodeling of a room or the removal of asbestos from a particular area often requires a temporary shelter of this nature. A primary objective in this situation is to contain dust or airborne particles within the shelter so that they do not escape into the rest of the structure.

Temporary or construction shelters and methods of making the same which are known in art provide a satisfactory shelter structure, but fail in providing an inexpensive and reliable means for entry and exit into the shelter.

As will be described in greater detail hereinafter, the temporary shelter of the present invention differs from those previously proposed.

SUMMARY OF THE INVENTION

Accordingly, it is an object of this invention to provide an easily installed temporary shelter.

Another object of this invention is provide a temporary shelter having an improved entry and exit system.

Still another object of this invention is to provide an entry and exit system that is capable of being locked so that forcible entry would be recognized.

Yet another object of this invention is to provide temporary shelter that is long lasting and can be inexpensively constructed.

To achieve the foregoing and other objectives, and in accordance with the purposes of the present invention a temporary shelter for use with an existing frame structure is provided. The temporary shelter has a flexible sheet having a pair of parallel slits. The flexible sheet encloses the frame structure to define an inner shelter space. A pair of zipper structures are provided. Each zipper structure has a separable zipper chain composed of two interlocking halves having fastening elements attached to flexible tapes. The fastening elements are interlocked and separated by a slider. The slider is operatively connected to the interlocking halves. Each flexible tape has an adhesive strip located on a back portion of the flexible tape and extends along side and parallel to the fastening elements. The adhesive strips of the zipper structures are attached to an outside surface of the flexible sheet so that the zipper structures are in a parallel spaced apart upright relationship from one another with each zipper chain being adjacent and parallel to one of the slits to provide a closeable opening in the flexible sheet for allowing access into the inner shelter space.

In accordance with an aspect of the invention, hook and loop type fastening structures are provided for detachably securing a bottom edge of the flexible sheet between the zipper structures to a floor.

In accordance with another aspect of the invention, a pair fastening straps are provided. The fastening straps having first ends connected to opposite sides of the flexible sheet and second ends extending around the portion of the flexible sheet in a rolled up position and in secured engagement with one another.

In accordance with a method of providing a temporary shelter having entry and exit system the following steps are provided: defining an inner shelter space with a flexible sheet; attaching a pair of self-applying zipper structures to an outside surface of the flexible sheet in a spaced apart upright relationship from one another; and cutting a pair of spaced apart slits in the flexible sheet which are parallel to and in alignment with the zipper structures to provide a closeable opening in the flexible sheet for allowing access into the inner shelter space.

In accordance with aspects of the method of the invention, additional further steps may be provided. These steps include the following: attaching mated hook and loop type fastening surfaces to a bottom edge of the flexible sheet between the zipper structures and to a floor for detachably securing the bottom edge to the floor; attaching a pair of straps to opposite sides of the flexible sheet for securing a portion of the flexible sheet between the zipper structures in a rolled up position; fastening a pair of eyeling screws to a floor; and locking the temporary shelter with a pair of locks, each of said locks securing a pull tab from each zipper structure to one of said eyeling screws.

Other objects, features and advantages of the invention will become more readily apparent upon reference to the following description when taken in conjunction with the accompanying drawings, which drawings illustrate several embodiments of the invention.

BRIEF DESCRIPTION OF THE DRAWINGS

In the drawings:

FIG. 3 is a front view of a zipper structure of the present invention;

FIG. 4 is a perspective view of a zipper structure of the present invention;

DETAILED DESCRIPTION OF THE PREFERRED EMBODIMENT

Figure 1:
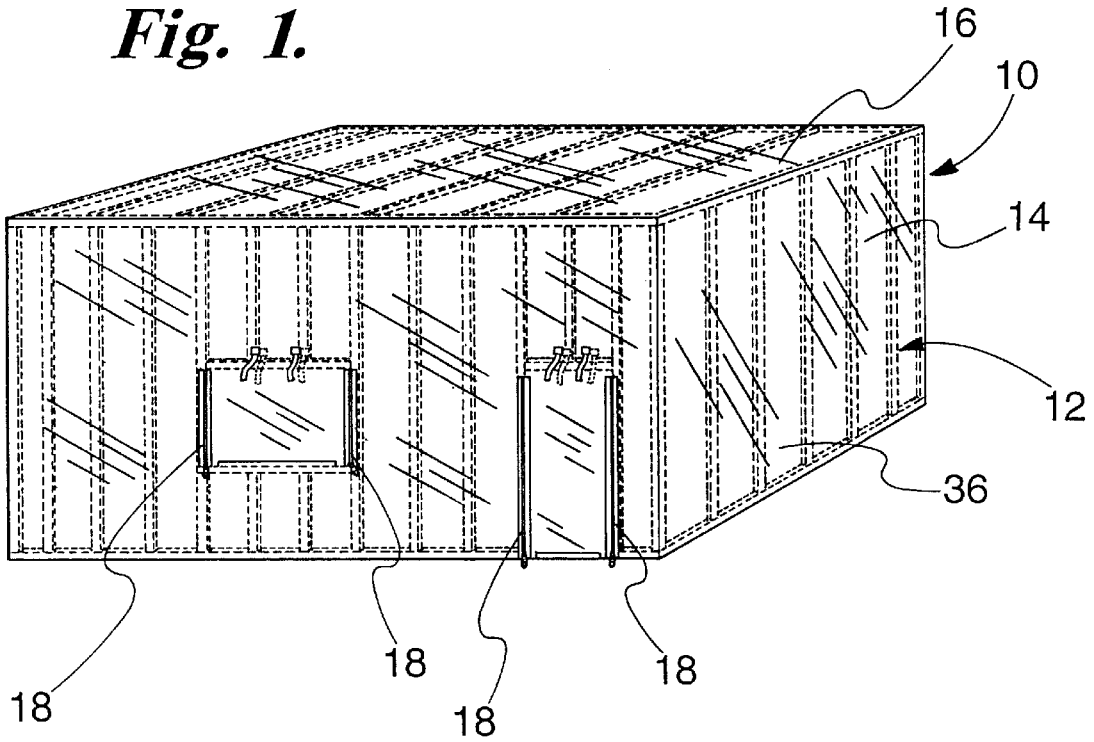
FIG. 1 is a perspective view of a temporary shelter constructed in accordance with the teachings of the present invention.
Figure 5:
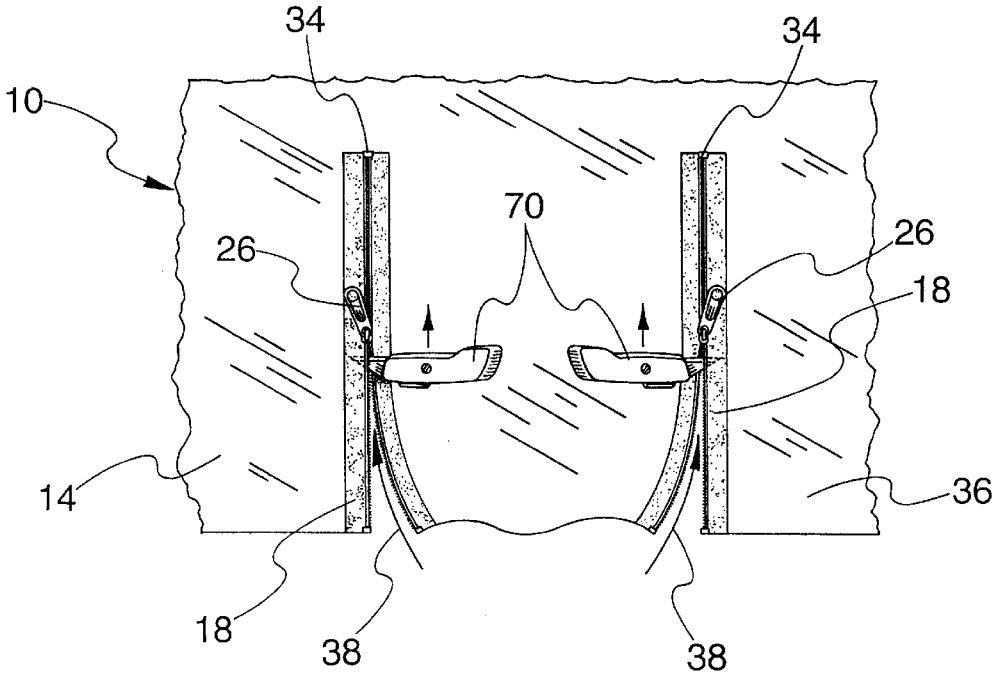
FIG. 5 is a side view of the present invention.
Figure 6:
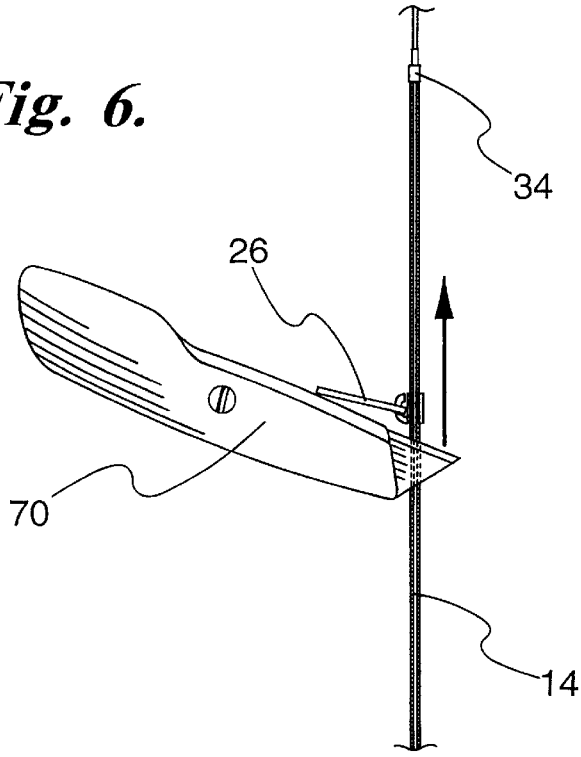
FIG. 6 is a partial side view of the present invention showing a knife cutting a slit in the flexible sheet.

Referring now to the drawings, FIG. 1 shows a temporary or construction shelter 10 for use with an existing frame structure 12. The temporary shelter 10 has a flexible sheet 14 having a pair of parallel slits 38, as best illustrated in FIGS. 5 and 6.

The flexible sheet may be formed by a number of materials including canvas, nylon, vinyl and plastic. Preferably, the flexible sheet 14 is a clear synthetic polyethylene plastic sheeting, generally referred to as "Visqueen". The flexible sheet 14 will have a thickness anywhere in the range of 2 to 30 mil. Generally, a thinner flexible sheet 14 will be used in home building construction, whereas commercial applications will require a flexible sheet having a greater thickness for additional durability.

Referring to FIG. 1, the temporary shelter 10 utilizes an existing exterior frame structure 12 of a building under construction. In home construction, the exterior frame structure 12 will often include a number of vertically spaced boards of lumber creating side walls and a flat roof. In commercial construction, the frame structure 12 will often be made of steel girders or brick. It is to be understood and any style of frame structure creating side walls and a flat roof portion either open or closed will provide a sufficient structure for enclosing with the flexible sheet. For example, a simple box frame used for vendor or painting booths may be utilized.

Figure 2:
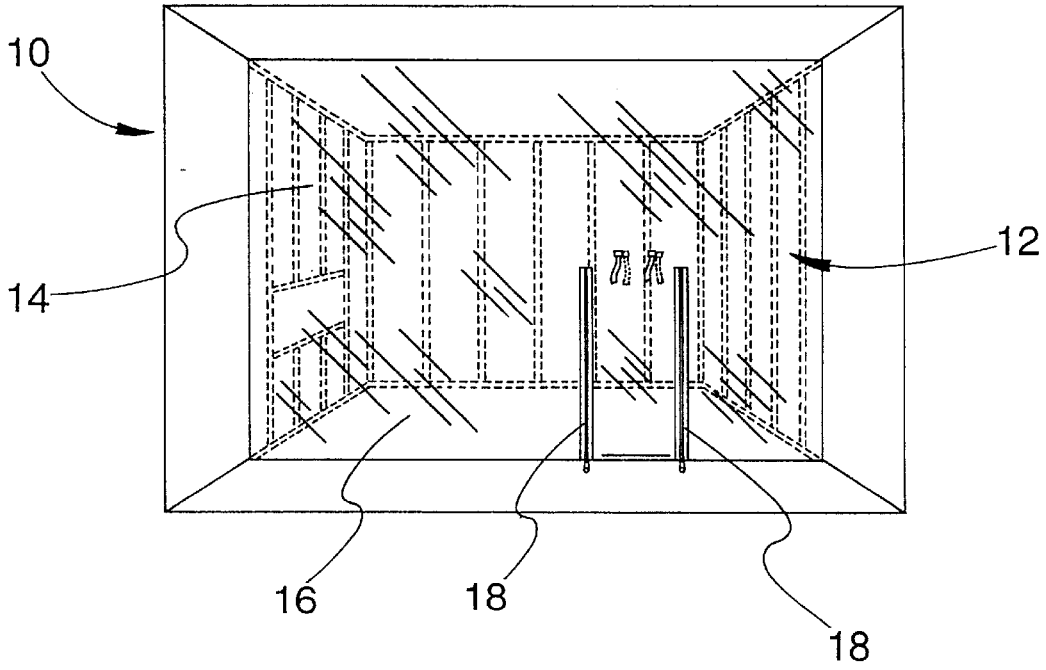
FIG. 2 is a perspective view of an alternative construction of the temporary shelter.

Referring to FIG. 2, the temporary shelter 10 is constructed within an existing structure interior. This manner of construction allows to contain or separate a particular area from the rest of a building so that dust or airborne particles within the shelter do not escape into the rest of the structure.

The flexible sheet 14 shown in FIGS. 1 and 2 encloses the frame structure 12 or portions thereof to define an inner shelter space 16. To provide an entry and exit system for the temporary shelter 10, pair of zipper structures 18 of conventional design are provided. As best illustrated in FIGS. 3 and 4, each zipper structure 18 has a separable zipper chain 20 composed of two interlocking halves having fastening elements 22 attached to flexible tapes 25. The interlocking halves having confronting front side edges and first ends. The flexible tapes 25 are preferably formed from a nylon or synthetic plastic woven material. The fastening elements 22 are interlocked and separated a slider 24 in a closed position to provide confronting front side edges with the first ends of the interlocking halves being adjacent to one another, the fastening elements being separated by a slider in an open position with the first ends of the interlocking halves being positionable in outwardly extending directions from one another. The slider 24 is operatively connected to the interlocking halves. Stops 34 are connected to the flexible tapes at opposite ends of the zipper structure 18 so that the slider may not be disengaged from the interlocking halves. Preferably, the slider 24 has a pair of pull tabs 26 for moving the slider from a front side and a back side of the zipper structure 18. Light weight zipper structures of conventional design will work sufficiently when using a flexible sheet having a lesser thickness, such as in home construction. However, larger heavy duty zipper structures having larger fastening elements 22 and wider tapes 25 will be used in commercial settings where additional durability is needed.

Each flexible tape 25 has an adhesive strip 28 located on a back portion 30 of the flexible tape 25 and extends along side and parallel to the fastening elements 22 so that the zipper structure can be self-applied. Preferably, the adhesive strip 28 is formed from a pressure sensitive acrylic tape type adhesive. The use of wider tapes 25 will allow for wider adhesive strips 28 to create a stronger bond between the adhesive strip 28 and the flexible sheet 14. A protective strip 32 having a wax type surface is applied to the adhesive strip 28 along the length of the zipper structure 18. The protective strip 32 protects the adhesive strip 28 until the zipper structures 18 are ready to be applied to the flexible sheet 14, at which point the protective strip may be removed and discarded by peeling away the strip 32 causing the adhesive strip 28 to disengage from the wax type surface of the protective strip 32.

Figure 8:
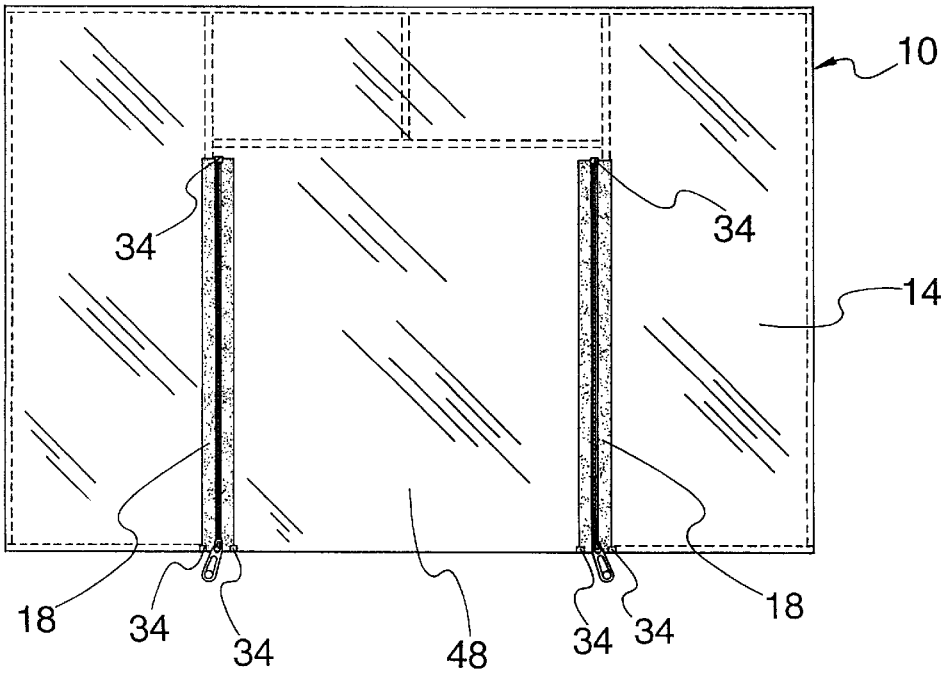
FIG. 8 is a side view of the present invention.

As best shown in FIGS. 1, 2 and 8, the adhesive strips 28 of the zipper structures 18 are attached to an outside surface 36 of the flexible sheet 14 so that the zipper structures are in a parallel spaced apart upright relationship from one another with each zipper chain being adjacent and parallel to one of the slits 38, with each slit 38 cut into the flexible sheet extending adjacent to the zipper chain to a bottom edge of the flexible sheet, to provide a closeable rectangular or door-shaped opening in the flexible sheet 14 for allowing access into the inner shelter space 16. Since most adhesive requires at least some amount of time to dry before giving full strength, an additional securing means, such as staples or tacks, may be used to secure opposite ends of the zipper structure 18 to the flexible sheet 14 so that utilization of the zipper structure 18 before adequate bonding time does not disengage the adhesive strips 28.

Figure 10:
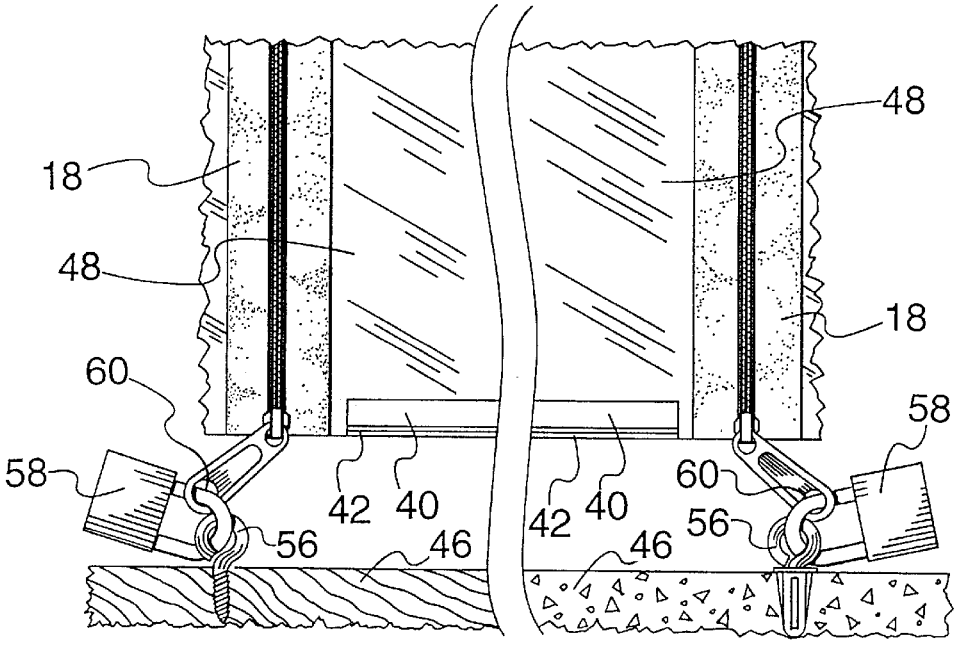
FIG. 10 is a side view of an alternative embodiment of the present invention.

Referring now to FIG. 10, a mated pair of a hook and loop type fastening structures 40, 42, such as the self-applied hook and loop fastening structures manufactured under the registered trademark VELCRO, are provided for detachably securing a bottom edge 44 of the flexible sheet 14 between the zipper structures to a floor 46.

Figure 7:
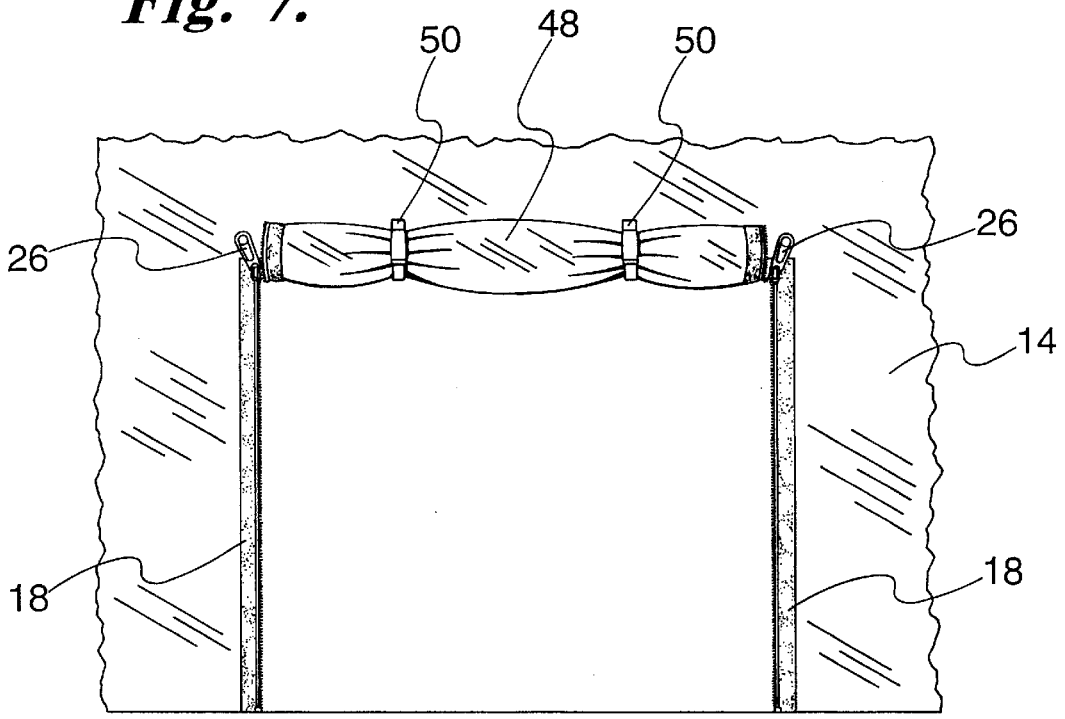
FIG. 7 is a side view of the present invention showing a door flap in a rolled up secured position.

Referring to FIGS. 7 and 10, to secure a portion of the flexible sheet between the zipper structures or door flap 48 in a rolled up position, a pair fastening straps 50 are provided. The door flap being defined by the pair of slits 38 and a door flap edge, which is the bottom edge of the flexible sheet between the slits. The fastening straps 50 have first ends 52 connected to opposite sides of the flexible sheet 14 and second ends 54 which can be extended around the door flap 48 in a rolled up position and can be secured to one another. In one embodiment, VELCRO is used to attach the straps 50 to the flexible sheet 14. The second ends 54 of the straps 50 are then tied together to secure the door flap 48 in an rolled up or folded up position. In an alternative embodiment, the straps 50 are formed from VELCRO and are detachably secured to one another to hold the door flap 48. Additional pairs of straps 50 may be needed depending on the width of the door flap 48.

Referring to FIG. 10, a pair of eyelet or eyeling screws 56 are fastened to the floor 46 outside of the temporary shelter 10 adjacent to the zipper structures 18. A pair of locks 58 are used to secure the temporary shelter 10. Therefore, if someone breaks into the temporary shelter 10 it would constitute breaking and entering into a locked enclosure and may provide greater legal protection. Each of the locks are secured to one of the pull tabs 26 through a pull tab opening 60 from each zipper structure 18 to one of the eyeling screws 56.

Figure 9:
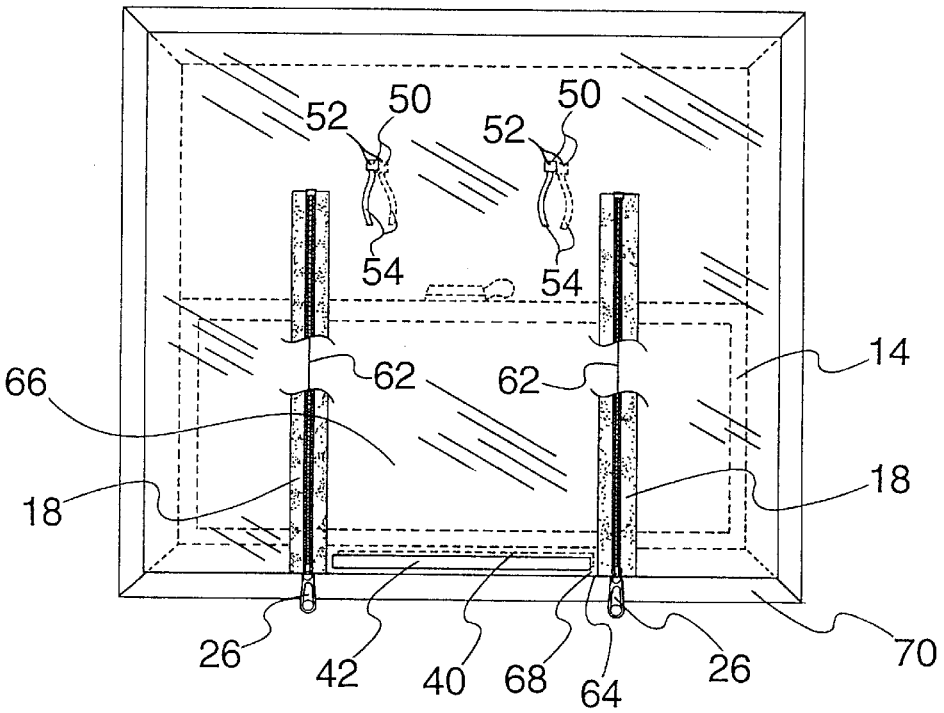
FIG. 9 is a partial side view of the present showing a window flap.

Referring to FIG. 9, a window opening may be similarly created. An additional pair of zipper structures 18 are connected to an outside or inside surface of the flexible sheet 14 by the adhesive strips 28 of the zipper structures 18, The zipper structures are in a parallel spaced apart upright relationship from one another. The flexible sheet 14 has a pair of vertical window slits 62 adjacent and parallel to the zipper chains of the zipper structures 18. A horizontal window slit 64 connects the vertical window slits 62 at a lower end of the vertical window slits 62 to provide a window flap 66 that can be opened or closed with use of the zipper structures 18.

A mated pair of a hook and loop type fastening structures 40, 42 are provided for detachably securing a window flap edge 68 to a window ledge 70. To secure the window flap in an open or rolled up position, a pair fastening straps 50 are provided and secured in a manner similar to that previously described.

In a method of providing a temporary shelter 10, the first step involves attaching the flexible sheet 14 to the existing frame structure 12 to define the inner shelter space 16. More than one flexible sheet 14 may be needed to cover the frame structure 12. For example, one sheet of material may be used to cover two side walls and the roof of the frame structure 12 and another sheet of material may perpendicularly cross the first sheet to cover the other two side walls, as well as covering the roof will a second layer of material. Staples, nails, or tape may be used to secure the flexible sheet 14 to the frame structure 12 so that it does not shift or slide. In addition, any overlapping or confronting edges may be taped if needed.

The next step involves attaching a pair of self-applying zipper structures to an outside surface of the flexible sheet in a spaced apart upright relationship from one another after the protective strips 32 are removed from the adhesive strips 28. This step more specifically involves removing or peeling away the protective strips 32 away from the flexible tapes 25 to expose the adhesive surface of the adhesive strips 28 to permit the adhesive strips 28 to be readily attached to the flexible sheet 14.

The next step involves cutting a pair of spaced apart parallel slits 38 in the flexible sheet 14 which are parallel to and in alignment with the zipper structures 18 to provide a closeable opening in the flexible sheet 14 for allowing access into the inner shelter space 16. As shown in FIGS. 5 and 6, the best method of cutting involves inserting a razor knife 70 into the flexible sheet 14 and cutting while moving the slider 24 to separate the zipper chain 20 at the same time. This same procedure is similarly followed when installing a window flap 66. Additional method features and steps are those which have been previously described above.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A temporary shelter for use with an existing frame structure having a closeable door-shaped opening for allowing access into the shelter with the door-shaped opening being installable by a user at a desired selectable location, the temporary shelter comprising in combination:

(a) a flexible sheet defining an inner shelter space;

(b) a pair of zipper structures, each zipper structure having a separable zipper chain composed of two interlocking halves having front side edges and first ends, the interlocking halves having fastening elements attached to flexible tapes substantially along the front side edges, the fastening elements being interlocked by a slider in a closed position to provide confronting front side edges with the first ends of the interlocking halves being adjacent to one another, the fastening elements being separated by the slider in an open position with the first ends of the interlocking halves being positionable in outwardly extending directions from one another, the slider operatively connected to the interlocking halves, each flexible tape having an adhesive strip located on a back portion of the flexible tape and extending along side and parallel to the fastening elements, a pair of protective strips, each of said protective strips in removable engagement with the adhesive strip of each zipper structure, the adhesive strips of the zipper structures attached to an outside surface of the flexible sheet when the protective strips are disengaged with back portions of the flexible tapes in confronting engagement with the outside surface of the flexible sheet so that the zipper structures are in a parallel spaced apart upright relationship from one another with each zipper chain being adjacent and parallel to a slit cut into the flexible sheet extending immediately adjacent to the zipper chain to a bottom edge of the flexible sheet to provide the closeable door-shaped opening in the flexible sheet for allowing access into the inner shelter space, the closeable door-shaped opening defining a rectangular shaped door flap having a width selectable by the user, each slider having a pair of pull tabs; and (c) a pair of eyeling screws fastened to a floor and a pair of locks, each of said locks securing one of said pull tabs from each zipper structure to one of said screws.

2. The combination of claim 1, further comprising a hook and loop type fastening means for detachably securing a bottom edge of the flexible sheet between the zipper structures to a floor.

3. The combination of claim 1, further comprising means for securing a portion of the flexible sheet between the zipper structures in a rolled up position.

4. The combination of claim 3, wherein the means for securing a portion of the flexible sheet between the zipper structures in a rolled up position is a pair fastening straps having first ends connected to opposite sides of the flexible sheet and second ends extending around the portion of the flexible sheet in a rolled up position and in secured engagement with one another.

5. The combination of claim 1, further comprising an additional pair of zipper structures connected to the flexible sheet by the adhesive strips of the zipper structures, the zipper structures being in a parallel spaced apart upright relationship from one another, the flexible sheet having a pair of vertical window slits adjacent and parallel to the zipper chains of the zipper structures, and a horizontal window slit connecting the vertical window slits at a lower end of the vertical window slits to provide a window flap that can be opened or closed with use of the zipper structures.

6. The combination of claim 5, further comprising hook and loop type fastening means for detachably securing the horizontal window slit to the existing frame structure.

7. The combination of claim 6, further comprising means for securing the window flap in an open position.

8. A method of providing a temporary shelter having a closeable door-shaped opening for allowing access into the shelter with the door-shaped opening being installable by a user at a desired selectable location, comprising the steps of:

(a) defining an inner shelter space with a flexible sheet;

(b) attaching a pair of self-applying zipper structures to an outside surface of the flexible sheet in a spaced apart upright relationship from one another by peeling away protective strips removably secured to the pair of self-applying zipper structures to expose adhesive strips disposed on a back portion of the zipper structures and pressing the adhesive strips in confronting engagement with the outside surface of the flexible sheet;

(c) cutting a pair of spaced apart parallel slits in the flexible sheet which are parallel to and in alignment with the zipper structures to provide the closeable door-shaped opening and form a closeable door flap in the flexible sheet defined by the pair of parallel slits and a door flap edge of the flexible sheet for allowing access into the inner shelter space, the door flap having a width selectable by the user;

(d) fastening a pair of eyeling screws to a floor; and (e) locking the temporary shelter with a pair of locks, each of said locks securing a pull tab from each zipper structure to one of said eyeling screws.

9. The method of claim 8, further comprising the step of attaching mated hook and loop type fastening surfaces to a bottom edge of the flexible sheet between the zipper structures and to a floor for detachably securing the bottom edge to the floor.

10. The method of claim 8, further comprising the step of attaching a pair of straps to opposite sides of the flexible sheet for securing a portion of the flexible sheet between the zipper structures in a rolled up position.

11. A method of providing a temporary shelter entry and exit system, the temporary shelter defining an inner shelter space with a flexible sheet having a closeable door-shaped opening for allowing access into the shelter with the door-shaped opening being installable by a user at a desired selectable location, the method comprising the steps of:

(a) attaching a pair of self-applying zipper structures to an outside surface of the flexible sheet in a spaced apart relationship from one another by peeling away protective strips removably secured to the pair of self-applying zipper structures to expose adhesive strips disposed on a back portion of the zipper structures and pressing the adhesive strips in confronting engagement with the outside surface of the flexible sheet;

(b) cutting a pair of spaced apart slits in the flexible sheet which are parallel to and in alignment with the zipper structures to provide the closeable door-shaped opening and form a closeable door flap in the flexible sheet defined by the pair of slits and a door flap edge of the flexible sheet for allowing access into the inner shelter space, the door flap having a width selectable by the user;

(c) attaching mated hook and loop type fastening surfaces to a bottom edge of the flexible sheet between the zipper structures and to a floor for detachably securing the bottom edge to the floor;

(d) fastening a pair of eyeline screws to a floor; and (e) locking the temporary shelter with a pair of locks, each of said locks securing a pull tab from each zipper structure to one of said eyeling screws.

12. A method of providing a temporary shelter having a closeable door-shaped opening for allowing access into the shelter with the door-shaped opening being installable by a user at a desired selectable location, comprising the steps of:

(a) defining an inner shelter space with a flexible sheet;

(b) attaching a pair of self-applying zipper structures to an outside surface of the flexible sheet in a spaced apart upright relationship from one another by peeling away protective strips removably secured to the pair of self-applying zipper structures to expose adhesive strips disposed on a back portion of the zipper structures and pressing the adhesive strips in confronting engagement with the outside surface of the flexible sheet;

(c) cutting a pair of spaced apart parallel slits in the flexible sheet which are parallel to and in alignment with the zipper structures to provide the closeable door-shaped opening and form a closeable door flap in the flexible sheet defined by the pair of parallel slits and a door flap edge of the flexible sheet for allowing access into the inner shelter space, the door flap having a width selectable by the user;

(d) attaching an additional pair of self-applying zipper structures to an outside surface of the flexible sheet in a spaced apart upright relationship from one another;

(e) cutting a window flap into the flexible sheet which includes pair of spaced apart parallel slits in the flexible sheet which are parallel to and in alignment with the additional zipper structures to provide a window opening; and (f) attaching mated hook and loop type fastening surfaces to a bottom window flap edge and a window ledge for detachably securing the bottom window flap edge to the window ledge of an existing frame structure.

13. The method of claim 12, further comprising the step of attaching a strap to the flexible sheet for securing the window flap in a rolled up position.

* * * * *